United States Patent [19]

Zane

[11] 4,078,404

[45] Mar. 14, 1978

[54] CLASP ASSEMBLY

[76] Inventor: James E. Zane, 13693 Pinecrest Dr., Largo, Fla. 33540

[21] Appl. No.: 721,830

[22] Filed: Sep. 9, 1976

[51] Int. Cl.[2] ..... E05B 65/48

[52] U.S. Cl. ..... 70/8; 70/75; 16/128 R

[58] Field of Search ..... 70/2–13, 70/69–75; 16/128 R, 128 A, 128.1, 135, 168, 191, DIG. 13

[56] References Cited

U.S. PATENT DOCUMENTS

| | | | |
|---|---|---|---|
| 775,957 | 11/1904 | Wilson | 70/9 |
| 1,970,196 | 8/1934 | Rodemeyer | 16/168 |
| 2,051,428 | 8/1936 | Taflow | 16/128 R |
| 2,078,076 | 4/1937 | Hines | 16/128 R |
| 2,701,384 | 2/1955 | Barroero | 16/128 R |
| 2,852,802 | 9/1958 | Seby | 16/135 |
| 3,233,277 | 2/1966 | Hireshiki | 16/168 |
| 3,349,427 | 10/1967 | Cairns | 16/128 R |

*Primary Examiner*—Robert L. Wolfe

*Attorney, Agent, or Firm*—Duckworth, Hobby & Allen

[57] ABSTRACT

A clasp assembly of the type designed to lockingly secure a cover element to some type of body, housing or support platform wherein the clasp assembly includes a hinge plate having an angularly oriented configuration so as to substantially conform to the outer configuration of the mated lid and support platform. A hinge assembly is structurally defined by cooperating elements of both the hinge plate and the base of the hinge assembly to which it is attached. The hinge assembly comprises a pivot pin interconnected to both the base portion and the hinge plate to define a movable interconnection therebetween wherein the base portion is secured to the support platform.

6 Claims, 3 Drawing Figures

CLASP ASSEMBLY

BACKGROUND OF THE INVENTION

1. Field of the Invention

This invention relates to a clasp assembly of the type primarilydesigned to lockingly engage separable structural elements to one another such as a base or support platform and a cover or lid member mounted thereon. At least one portion of the hinge assembly is pivotable between a locked and unlocked engaging position relative to one of the separable elements and is otherwise mounted in interconnecting relation to the opposite of the separable elements.

2. Description of the Prior Art

Innumerable variations in locks, clasps, and like interconnecting assemblies are known in the patented prior art as well as being commercially available. Generally, such interconnecting structures are specifically structured so as to be adapted to a particular application.

Obviously, the number of variations in design, size, configuration, and overall dimension of various types of "containers" with which conventional or prior art type locking assemblies can be utilized is also quite extensive. Accordingly, the number of interconnecting type elements is equally as extensive.

The term "containers," for the purpose of discussing the scope of description and protection of the present invention, is meant to include any type of combination lid or cover and base, housing or casing structure. Such "containers" are meant to include, but certainly not be limited to, luggage, car top carriers, trunks, and generally similar type containers wherein it is desirable and necessary for the effective operation of the container structure to periodically but securely attach the lid portion to the base or housing portion.

As set forth above, numerous of such prior art devices are the subject of patents and also are commercially available. However, a great number of such prior art structures suffer from inherent problems which make their use less than effective and lessen their desirability. Such problems include overly complex structures which add both to the maintenance or repair of such prior art items as well as the initial expenditure. In addition, numerous articles or containers on which such clasp type assemblies are mounted include luggage or the like as set forth above. Such luggage frequently undergoes substantially abusive treatment during its handling and accordingly the clasp assembly used thereon frequently has a short operable life. Also, such treatment results in a severe lessening of their effectiveness even if such treatment does not result in complete inoperability.

In addition, it is common practice to physically locate such clasp assemblies on the exterior surface of any container or like structure and accordingly a major concern of the use of such a interconnecting structure should be its adaptability to the aesthetic appearance of the container structure itself.

Accordingly, there is an obvious need in this particular area of commerce for an interconnecting structure assembly which is capable of being adapted to any number of a wide variety of designs in "containers" incorporating the need of securing a removable or pivotally attached lid or cover structure to a casing, housing or support platform type base. However, the design of such needed structure should be such as to render it durable and relatively inexpensive to maintain and for initial purchase so as to make it economically feasible for adaptation to a number of various types of container type structures.

SUMMARY OF THE INVENTION

The present invention is directed towards a clasp assembly of the type primarily designed to lockingly interconnect the lid portion of a container to a base, support platform or casing on which the lid or cover is removably or pivotally mounted. The container or like structure to which the subject clasp assembly is attached is not, per se, a part of the present invention and may comprise a number of different types of container structures including car top carriers, luggage type structures, trunks, or similar type storage containers wherein the cover portion is removably or pivotally attached to a base, casing or what may be generically referred to as a support platform.

More specifically, the clasp assembly of the present invention comprises a hinge plate pivotally attached at one end to a base means. For purposes of the present invention, the base means is securely mounted on the support platform while the hinge plate is disposed and configured for pivotal movement into and out of locking engagement with the cover, casing or lid assembly.

The hinge plate includes a lock means secured to one end thereof and disposed for mating engagement with a lock receptor assembly fixedly attached to the side wall of the lid portion of the container on which the clasp assembly is mounted.

The opposite end of the hinge plate is pivotally connected to the base means by means of a hinge assembly. More specifically, a sleeve element is integrally or otherwise secured to the hinge plate and comprises at least a partially hollow interior having a somewhat elongated configuration. The hinge assembly further comprises a pivot pin having one end mounted in the sleeve means on the interior thereof. A ball element having a substantially and at least partially spherical configuration is disposed within the base means and more particularly, mounted within a socket portion of the base means. The ball element has a hollow interior which is substantially configured to correspond to one end of the pivot pin element. Accordingly, the hollow portion of the sleeve means is disposed in substantially aligned relation with the similarly hollow portion of the ball element such that these two hollow portions are disposed in aligned relation to one another for reception of the pivot pin.

In that the sleeve portion is mounted on the pivot pin, a movable, substantially pivotal hinge like connection is established between the hinge plate and the base means so that the hinge plate may be pivoted into and out of locking relation with the latch member formed on the side wall of the lid or cover portion as set forth above.

Another important structural feature of the present invention comprises the hinge plate having a substantially angular configuration defined along the length thereof. More specifically, the end of the hinge plate associated with the hinge assembly defines a substantially outwardly extending flange portion relative to the remainder of the hinge plate. Accordingly, disposition of the hinge plate is such as to have its outwardly extending flange portion disposed in rotating attachment to the base means while the free end of the hinge plate is positioned in locking engagement with the latch means and in substantially parallel relation to the wall surface or side wall of the cover or lid portion of the container on which the assembly is mounted.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
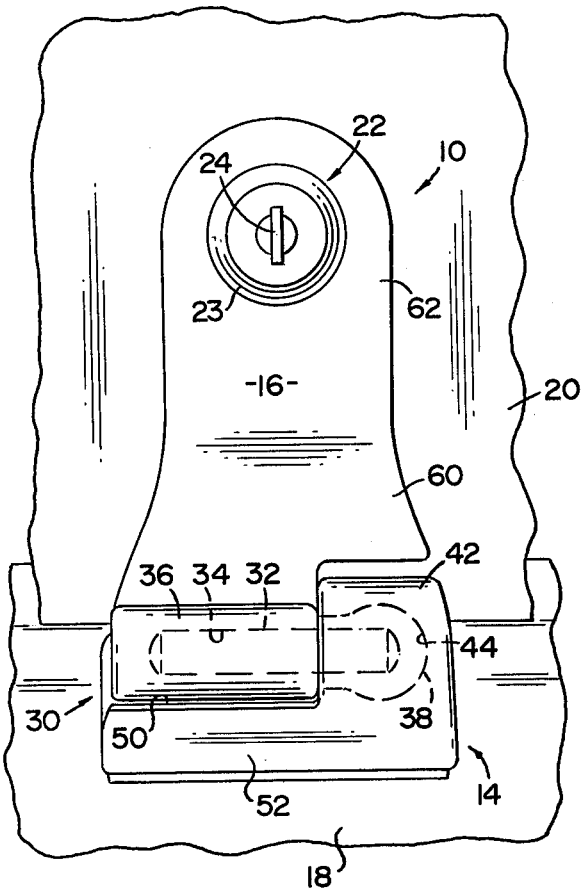
FIG. 1 is a front view, in partial cutaway, of the clasp assembly of the present invention in its locked attaching engagement with a lid portion of a container or like structure.
Figure 2:
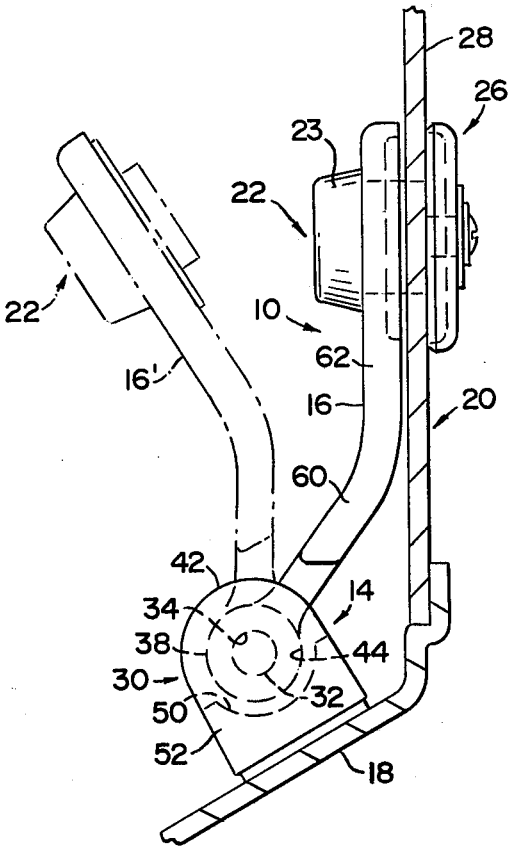
FIG. 2 is a sectional view of the embodiment in FIG. 1 with the additional open position of the hinge plate means represented in broken lines.

As best shown in FIGS. 1 and 2, the clasp assembly of the present invention is generally indicated as 10 and comprises a base means generally indicated as 14 having pivotally attached thereto a hinge plate 16. More specifically, a support platform 18 has removably or pivotally mounted thereon a cover structure or lid portion 20. The hinge plate 16 is such as to be pivotally disposed into and out of attachment to the lid portion 20.

A lock mechanism generally indicated as 22 is attached to the free end of hinge plate 16 and comprises a casing 23 and provision for a key or like activating instrument as at 24. Similarly, a latch mechanism generally indicated as 26 is mounted on the side wall 28 of the cover or lid portion 20 in corresponding relation to the lock mechanism 23. When the hinge plate 16 is disposed in its locked position as represented in FIGS. 1 and 2, the lock mechanism 23 is brought into locking registration with the latch mechanism 26 as best shown in FIG. 2. Accordingly, the lid portion or cover 20 is disposed in fixedly attached relation to the support platform 18.

Figure 3:
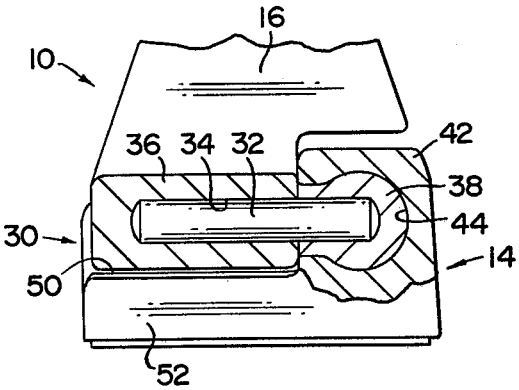
FIG. 3 is a detail view, in partial section, showing the comparative structural features of the hinge assembly.

With primary reference to FIGS. 1 and 3, the clasp assembly of the present invention comprises a hinge means generally indicated as 30 which includes a pivot pin 32 mounted within the interior channel 34 of sleeve portion 36. The sleeve portion 36 may be integrally or otherwise attached to the opposite end of hinge plate 16 relative to the lock mechanism 22. A ball element 38 has a substantially or at least partially spherical outer configuration matingly engaging the interior of the base housing 42 within socket 44. As is readily apparent, the interior configuration of the socket 44 substantially corresponds to that of the exterior configuration of the ball element 38. In addition, a hollow channel is formed on the interior of the ball element 38 which essentially corresponds to one end of the pivot pin 32. The hollow portions of the ball element 38 and the sleeve 36 are substantially disposed in aligned relation to one another so as to provide mating engagement by means of the pivot pin 32 between the hinge plate 16 and the base means 14.

Other structural features of the base means comprises the provision of a cradle means 50 integrally formed in the front portion 52 of the base means and having a substantially curvilinear configuration as readily apparent in broken lines in FIG. 2. The cradle means 50 is substantially, correspondingly configured to the outer surface of the sleeve means 36 so as to at least partially encase or surround the lower portion thereof and thereby allow clearance for rotational movement of the sleeve and the entire corresponding end of the hinge plate 16. This in turn allows for pivotal movement of the hinge plate into and out of locking engagement with the cover or lid portion 20.

Again, as represented in FIG. 2, the open or unlocked position of the hinge plate 16 is shown in broken lines and represented as 16'.

Another structural feature of the present invention comprises the one end of the hinge plate 16 indicated as 60 being formed into a substantially outwardly extending or angularly oriented flange portion relative to the remainder of the hinge plate indicated as 62. Therefore, this angular orientation allows for effective connection to the base means 14 as well as a substantially parallel or snug mating engagement of the remainder of the hinge plate 62 relative to the substantial plane defined by the side wall 28 of the lid or cover portion 20.

It will thus be seen that the objects set forth above, among those made apparent from the preceding description, are efficiently attained, and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention which, as a matter of language, might be said to fall therebetween.

Now that the invention has been described,

What is claimed is:

1. A clasp assembly of the type primarily designed to secure a lid element to a support platform, said clasp assembly comprising: base means adapted to be fixedly attached to the support platform; hinge plate means connected to said base means, said hinge plate comprising a sleeve means; said base means comprising a socket means formed therein and disposed in substantially aligned relation with said sleeve means; and a hinge means movably interconnected between said hinge plate and said base means, said hinge means including a pivot pin disposed to define a pivotal interconnection between said sleeve means and said socket means and a ball element connected to said base means, said ball element disposed in engaging relation to said pivot pin, said sleeve means including a first channel portion formed therein and defining a substantially elongated configuration substantially corresponding to the configuration of said pivot pin, and said ball element comprising a second channel portion formed therein in substantially aligned relation to said first channel portion, said pivot pin extending between said sleeve means and said ball element and having opposite end portions thereof mounted within said first and second channel portions, respectively, whereby said sleeve means is movably mounted relative to said ball element and whereby said hinge plate is pivotally connected to said base means.

2. A clasp assembly as in claim 1 further comprising a lock element mounted on said hinge plate at the substantially opposite end thereof relative to said sleeve means.

3. A clasp assembly as in claim 2 further comprising a latch member secured to the lid in receiving engagement with said lock member whereby the lid is secured to the support platform.

4. A clasp assembly as in claim 1 wherein said socket means comprises at least a partially spherical configuration, said ball element substantially, correspondingly configured to said socket means.

5. A clasp assembly as in claim 1 wherein said hinge plate comprises a substantially angular configuration along the longitudinal dimension thereof, said hinge plate comprising a flange formed substantially at one end thereof, said flange extending outwardly at a substantial angular orientation relative to the remainder of the hinge plate, said sleeve integrally attached to said flange, whereby said hinge plate is secured in locking relation between the lid and said base means; said base means mounted on the support platform in offset relation to the lid.

6. A clasp assembly as in claim 1 wherein said base means further comprises a cradle means disposed in receiving relation to said sleeve means and including a substantially curvilinear configuration, said sleeve means disposed for rotational movement relative to said base means and at least partially enclosed by said cradle means.

* * * * *